US007284403B2

(12) United States Patent
Wagner et al.

(10) Patent No.: US 7,284,403 B2
(45) Date of Patent: Oct. 23, 2007

(54) APPARATUS AND METHOD FOR PERFORMING A HYDROFORMING PROCESS

(75) Inventors: Nelson Wagner, Holland, OH (US); Jeffrey A. Dutkiewicz, Toledo, OH (US)

(73) Assignee: Torque-Traction Technologies LLC, Maumee, OH (US)

( * ) Notice: Subject to any disclaimer, the term of this patent is extended or adjusted under 35 U.S.C. 154(b) by 101 days.

(21) Appl. No.: 11/320,526

(22) Filed: Dec. 27, 2005

(65) Prior Publication Data

US 2007/0017267 A1 Jan. 25, 2007

Related U.S. Application Data

(60) Provisional application No. 60/639,505, filed on Dec. 28, 2004.

(51) Int. Cl.
*B21D 28/28* (2006.01)
*B21D 39/20* (2006.01)

(52) U.S. Cl. ..... 72/62; 72/61; 72/58; 29/421.1

(58) Field of Classification Search ..... 72/61, 72/62, 58; 29/421.1
See application file for complete search history.

(56) References Cited

U.S. PATENT DOCUMENTS 4,006,619 A * 2/1977 Anderson ..... 72/54
4,761,981 A * 8/1988 Kelly ..... 29/421.1
4,761,982 A * 8/1988 Snyder ..... 72/58
5,105,644 A 4/1992 Simon
5,170,557 A * 12/1992 Rigsby ..... 72/61
5,213,250 A 5/1993 Simon
5,233,855 A 8/1993 Maki et al.
5,737,952 A * 4/1998 Baumann et al. ..... 72/62
5,829,911 A 11/1998 Yokota
6,237,382 B1 5/2001 Kojima et al.
6,279,364 B1 * 8/2001 Morphy et al. ..... 72/61
6,497,128 B1 12/2002 Canfield et al.
6,543,266 B1 4/2003 Jaekel
6,662,447 B2 * 12/2003 Kuschel et al. ..... 72/58

* cited by examiner

*Primary Examiner*—David B Jones
(74) *Attorney, Agent, or Firm*—MacMillan, Sobanski & Todd, LLC

(57) ABSTRACT

An apparatus and method for performing a hydroforming process cause either or both of the opposed end portions of the workpiece to be deformed to achieve desired shapes therein. Initially, a workpiece having a pair of end portions is disposed within a die cavity defined by first and second die sections have cooperating recesses. A pair of end feed assemblies engage the end portions of the workpiece and deform such end portions to a desired shape. Pressurized fluid is provided within the workpiece either before, during, or after the deformation of the end portions of the workpiece to deform the central portion thereof it into a desired shape as defined by the die cavity.

20 Claims, 8 Drawing Sheets

APPARATUS AND METHOD FOR PERFORMING A HYDROFORMING PROCESS

CROSS-REFERENCE TO RELATED APPLICATIONS

This application claims the benefit of U.S. Provisional Application No. 60/639,505, filed Dec. 28, 2004, the disclosure of which is incorporated herein by reference.

BACKGROUND OF THE INVENTION

This invention relates in general to an apparatus and a method of performed a hydroforming process on a workpiece so as to deform a workpiece to achieve a desired shape. In particular, this invention relates to an improved apparatus and method for performing such a hydroforming process wherein either or both of the opposed end portions of the workpiece are also deformed to achieve desired shapes therein.

Hydroforming is a well known process that uses pressurized fluid to deform a closed channel workpiece to a desired shape. A typical apparatus for performing a hydroforming process includes a frame having first and second die sections that are supported for movement relative to one another between opened and closed positions. The first and second die sections have respective recesses formed therein that together define a die cavity having a shape that corresponds to a desired final shape for the workpiece. When moved to the opened position, the first and second die sections are spaced apart from one another to allow a workpiece to be inserted within the die cavity. When moved to the closed position, the die sections engage one another to enclose the workpiece within the die cavity. Although the die cavity is usually somewhat larger than the workpiece to be hydroformed, movement of the two die sections from the opened position to the closed position may, in some instances, cause some mechanical deformation of the workpiece. In any event, the workpiece is then filled with fluid, typically a relatively incompressible liquid such as water. Fluid pressure within the workpiece is increased to such a magnitude that the workpiece is deformed outwardly into conformance with the surface contour of the die cavity. As a result, the workpiece is deformed into the desired final shape.

In a typical hydroforming apparatus, the die sections are arranged such that the first die section is supported on a movable ram of the apparatus, while the second die section is supported on a stationary bed of the apparatus. A mechanical or hydraulic actuator is provided for moving the ram and the first die section to the opened position relative to the second die section, allowing a previously deformed workpiece to be removed from the die cavity and a new workpiece to be inserted within the die cavity. The actuator subsequently moves the ram and the first die section to the closed position relative to the second die section, allowing the hydroforming process to be performed. To maintain the die sections together during the hydroforming process, a clamping or retaining device may be provided. The clamping or retaining device mechanically engages the die sections (or, alternatively, the ram and the base upon which the die sections are supported) to prevent them from moving apart from one another during the hydroforming process. Such movement would obviously be undesirable because the shape of the die cavity would become distorted, resulting in undesirable variations in the final shape of the workpiece.

In order to facilitate the filling of the workpiece with fluid and the subsequent performance of the hydroforming process, the hydroforming apparatus is typically provided with a pair of end feed assemblies. The end feed assemblies are adapted to engage and seal against opposed end portions of the workpiece that protrude from the sides of the hydroforming die. Fluid can then be fed into the workpiece through either or both of the end feed assemblies to perform the hydroforming process. Additionally, the end feed assemblies can be used to exert forces axially inwardly against the opposed end portions of the workpiece during the hydroforming process. As a result, some of the material from the end portions of the workpiece is pushed within the hydroforming die as the interior portion of the workpiece is being deformed. This axial end feeding process minimizes the reduction in the wall thickness of the interior portion of the workpiece that otherwise might result during the hydroforming process. When the hydroforming process is completed, the end feed assemblies are disengaged from the opposed end portions of the workpiece to allow the workpiece to be removed from the hydroforming die.

Typically, the opposed end portions of the workpieces that are engaged by the end feed assemblies are generally hollow and cylindrical in shape. Such hollow cylindrical shape facilitates the engagement and sealing of the opposed end portions of the workpiece by the end feed assemblies, as described above. However, with known end feed assemblies, such opposed end portions of the workpiece are not deformed, either before, during, or after the hydroforming process. Thus, the opposed end portions of the workpiece remain in their original hollow and cylindrical shape after the hydroforming process is completed. Frequently, these hollow cylindrical end portions are not desired in the final hydroformed workpiece. Consequently, these hollow cylindrical end portions are typically removed from the hydroformed workpiece, such as by cutting, and discarded as scrap. Although this process has functioned satisfactorily, it has been found to be somewhat time consuming and wasteful. Thus, it would be desirable to provide an improved apparatus and method for performing a hydroforming process wherein either or both of the opposed end portions of the workpiece are also deformed to achieve desired shapes therein, thereby eliminating the need to remove and discard them.

SUMMARY OF THE INVENTION

This invention relates to an improved apparatus and method for performing a hydroforming process wherein either or both of the opposed end portions of the workpiece are deformed to achieve desired shapes therein. Initially, a workpiece having a pair of end portions is disposed within a die cavity defined by first and second die sections have cooperating recesses. A pair of end feed assemblies engage the end portions of the workpiece and deform such end portions to a desired shape. Pressurized fluid is provided within the workpiece either before, during, or after the deformation of the end portions of the workpiece to deform the central portion thereof it into a desired shape as defined by the die cavity.

Various objects and advantages of this invention will become apparent to those skilled in the art from the following detailed description of the preferred embodiments, when read in light of the accompanying drawings.

DETAILED DESCRIPTION OF THE PREFERRED EMBODIMENTS

Figure 1:
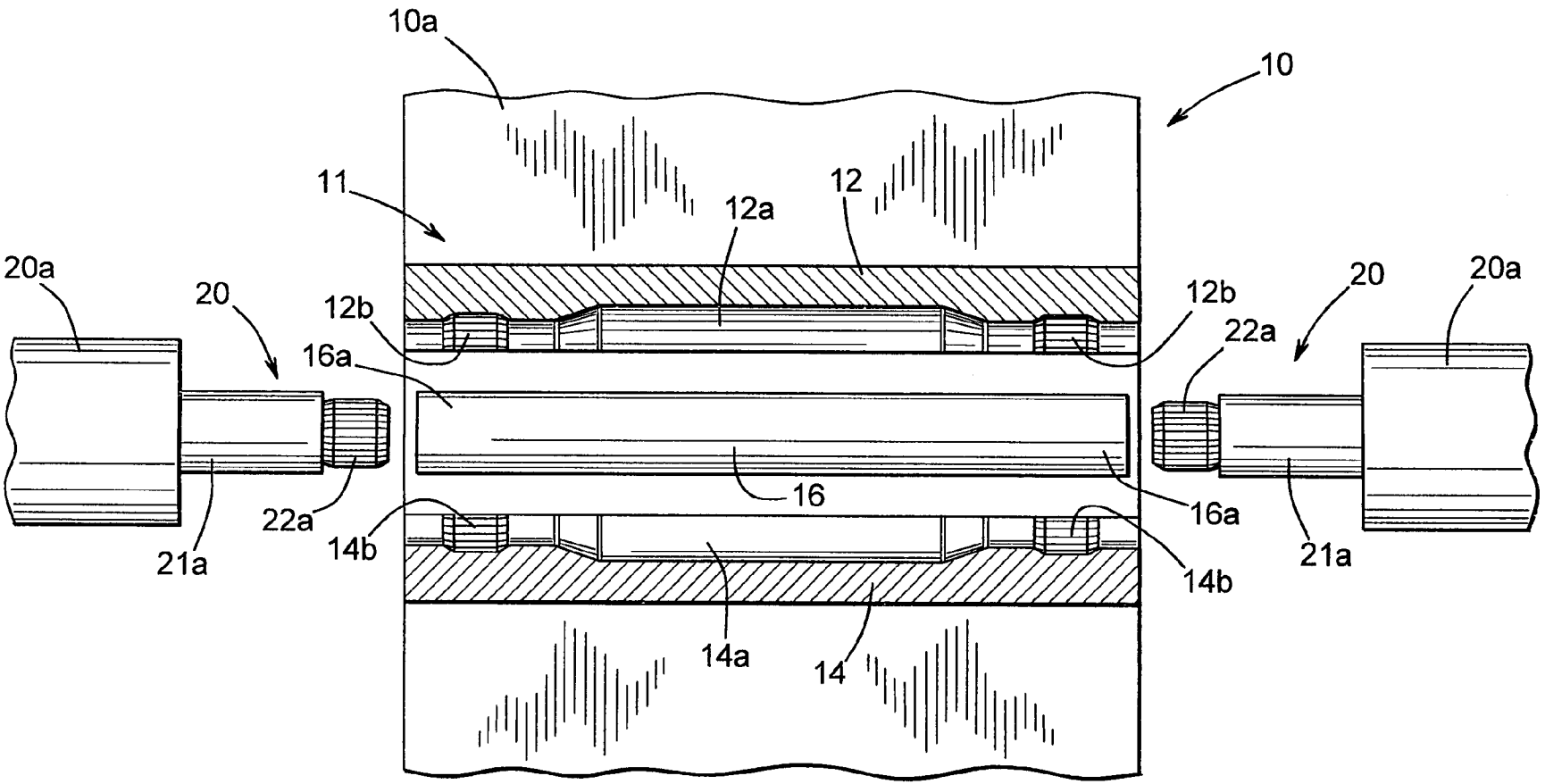
FIG. 1 is a side elevational view, partially in cross section, of a portion of a first embodiment of a hydroforming apparatus and a workpiece prior to being deformed by a hydroforming process in accordance with this invention, wherein a hydroforming die of the hydroforming apparatus is shown in the opened position.

Referring now to the drawings, there is illustrated in FIG. 1 a portion of a first embodiment of an apparatus, indicated generally at 10 for performing a hydroforming process in accordance with this invention. The apparatus includes a conventional frame 10*a* that supports a hydroforming die, indicated generally at 11, thereon. The hydroforming die 11 includes first and second die sections 12 and 14 that are supported for movement relative to one another between an opened position (illustrated in FIG. 1) and a closed position (illustrated in FIG. 2). The first and second die sections 12 and 14 have respective recesses 12*a*, 12*b* and 14*a*, 14*b* formed therein that, when the die sections are in the closed position, together define a die cavity. The die cavity has a shape that corresponds to a desired final shape for a workpiece 16 to be hydroformed. In the illustrated embodiment, the workpiece 16 is a hollow, cylindrical tube having a pair of opposed end portions 16*a*. However, the workpiece 16 may have any desired initial shape. The illustrated die cavity is defined by includes a central cavity area that is defined by the recesses 12*a* and 14*a* and a pair of end cavity areas that are respectively defined by the pairs of recesses 12*b* and 14*b*. The central cavity area defines a desired shape for the central or interior portion of the workpiece 16, while the two end cavity areas define respective desired shapes for the end portions 16*a* of the workpiece 16. Although this invention will be described in the context of both end portions 16*a* of the workpiece 16 being deformed, it will be appreciated that only one of such end portions 16*a* of the workpiece 16 need be deformed.

When moved to the opened position shown in FIG. 1, the first and second die sections 12 and 14 are spaced apart from one another to allow the workpiece 16 to be inserted within and removed from the die cavity. When moved to the closed position shown in FIG. 2, the first and second die sections 12 and 14 engage one another to enclose the workpiece 16 within the die cavity. Although the die cavity is usually somewhat larger than the workpiece 16 to be hydroformed, movement of the first and second die sections 12 and 14 from the opened position to the closed position may, in some instances, cause some mechanical deformation of the workpiece 16.

Typically, the first and second die sections 12 and 14 are arranged such that the first die section 12 is supported on a movable ram (not shown) of the hydroforming apparatus 10, while the second die section 14 is supported on a stationary bed (not shown) of the hydroforming apparatus 10. A mechanical or hydraulic actuator (not shown) is provided for moving the ram (and the first die section 12 supported thereon) to the opened position relative to the base (and the second die section 14 supported thereon), allowing a previously deformed workpiece 16 to be removed from the die cavity and the new workpiece 16 to be inserted within the die cavity. The actuator also moves the ram (and the first die section 12 supported thereon) to the closed position relative to the base (and the second die section 14 supported thereon), allowing the hydroforming process to be performed as described in detail below. To maintain the first and second die sections 12 and 14 together during the hydroforming process, the hydroforming apparatus 10 may include a clamping or retaining device (not shown). The clamping or retaining device engages the first and second die sections 12 and 14 (or, alternatively, the ram and the base upon which the first and second die sections 12 and 14 are supported) to prevent them from moving apart from one another during the hydroforming process.

In order to facilitate the filling of the workpiece 16 with fluid during the hydroforming process, the hydroforming apparatus 10 is provided with a pair of end feed assemblies, each indicated generally at 20. As will be explained in greater detail below, the end feed assemblies 20 are adapted to respectively engage and seal against the opposed end portions 16*a* of the workpiece 16 such that fluid can be fed into the workpiece 16 through either or both of the end feed assemblies 20 to perform the hydroforming process. Additionally, the end feed assemblies 20 can be used to exert axially inwardly directed forces against the opposed end portions of the workpiece 16 during the hydroforming process. As a result, some of the material from the end portions 16*a* of the workpiece 16 is pushed within the hydroforming die 11 as the interior portion of the workpiece 16 is being hydroformed. This axial end feeding movement of the end feed assemblies 20 can be accomplished in any desired manner, such as by respective conventional actuators 20*a*.

FIGS. 2 through 7 illustrate the structure of one of the end feed assemblies 20 in more detail and shows how the end feed assembly 20 is used to deform one of the end portions 16*a* of the workpiece 16, either before, during, or after the performance of the hydroforming process. The other end feed assembly 20 that engages the opposite end portion 16*a* of the workpiece 16 may have the same structure and perform the same operation if desired. The illustrated end feed assembly 20 includes a sealing portion 21 having an outer surface 21*a* and a generally axially facing shoulder 21*b*. The outer surface 21*a* of the sealing portion 21 of the end feed assembly 20 is preferably sized to be slightly smaller than the size of the die cavity defined at the outer side of the hydroforming die 11, but also slightly larger than the size of the end portion 16*a* of the workpiece 16 disposed within that portion of the die cavity. The reason for such relative sizing, as well as the purpose for the shoulder 21*b*, will be explained below.

Figure 2:
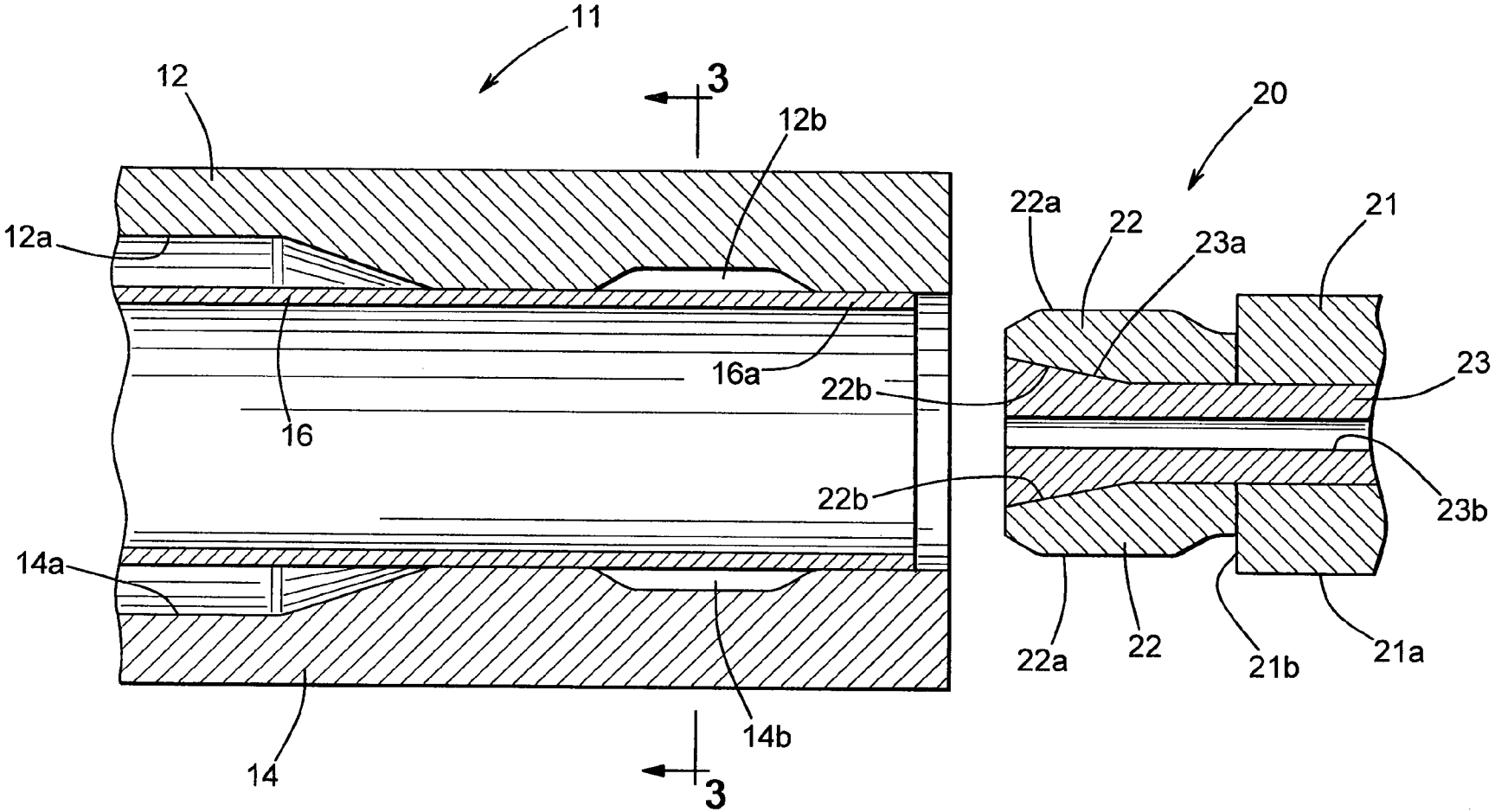
FIG. 2 is an enlarged side elevational view in cross section of the hydroforming die and the workpiece illustrated in FIG. 1, wherein the hydroforming die is shown in the closed position, and wherein an end feed assembly of the hydroforming apparatus is shown prior to engaging an end portion of the workpiece.
Figure 3:
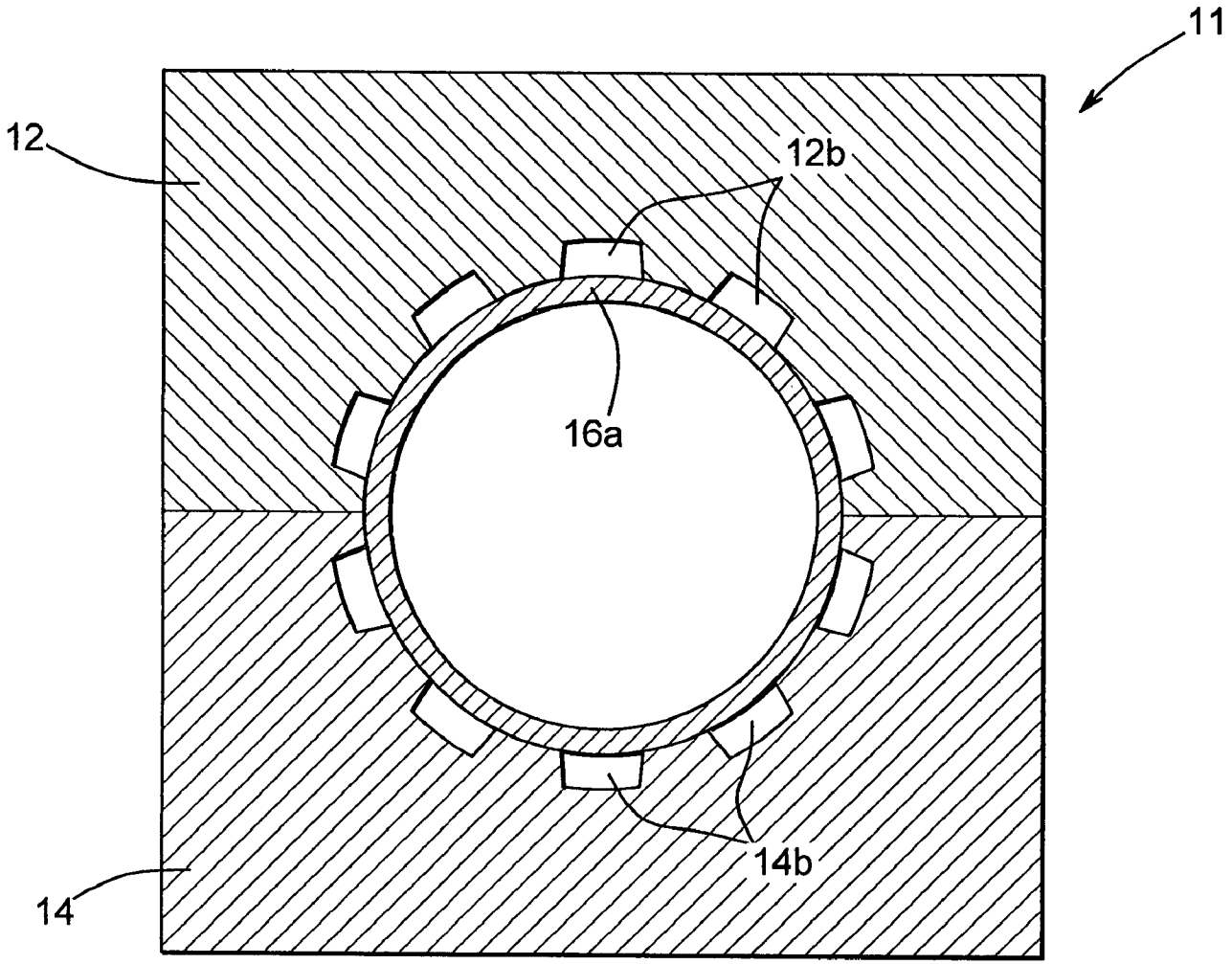
FIG. 3 is an enlarged sectional elevational view taken along line 3-3 of FIG. 2.
Figure 4:
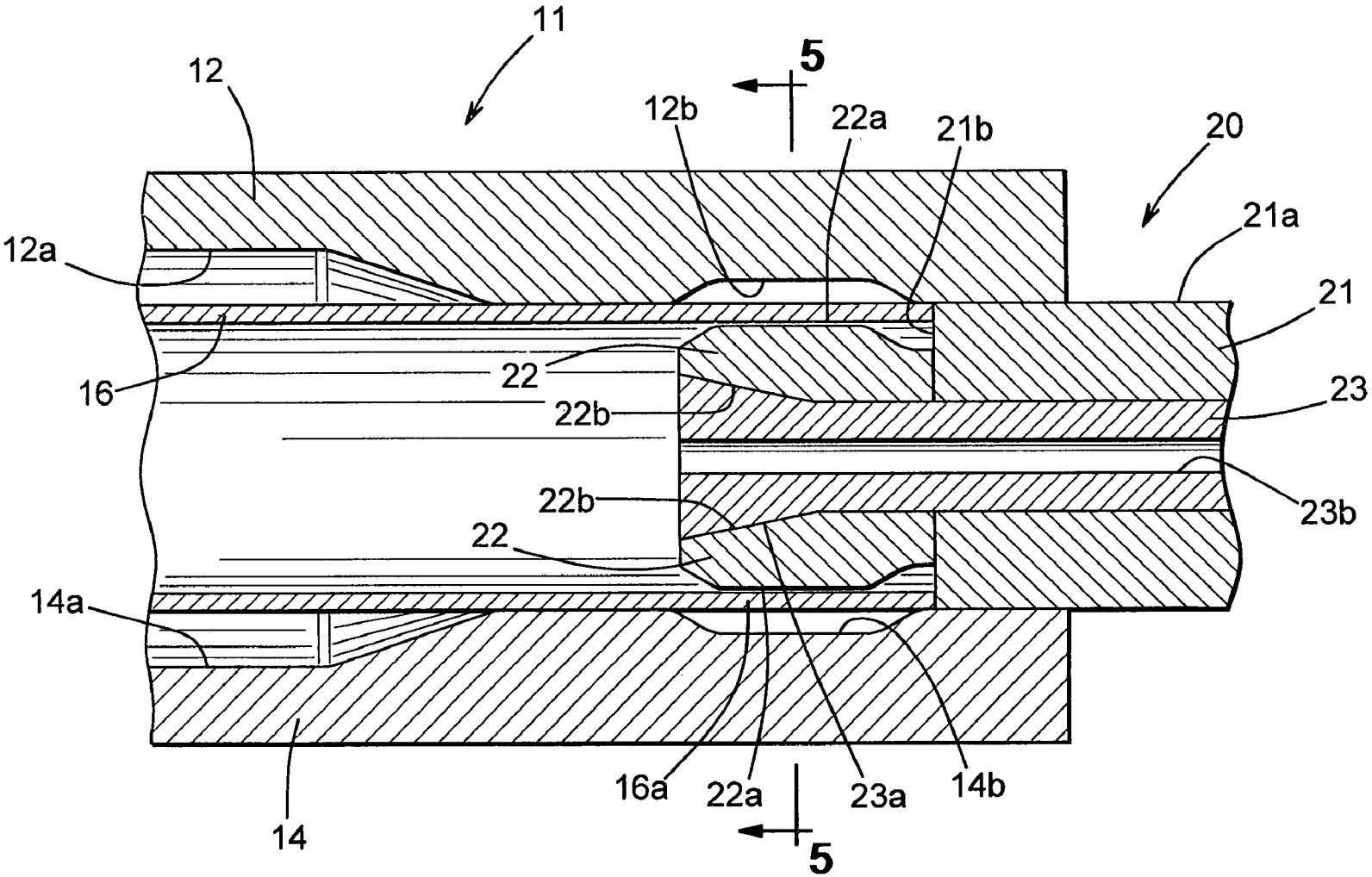
FIG. 4 is a side elevational view in cross section similar to FIG. 2 showing the end feed assembly after engaging an end portion of the workpiece but prior to being actuated to deform the end portion of the workpiece.
Figure 5:
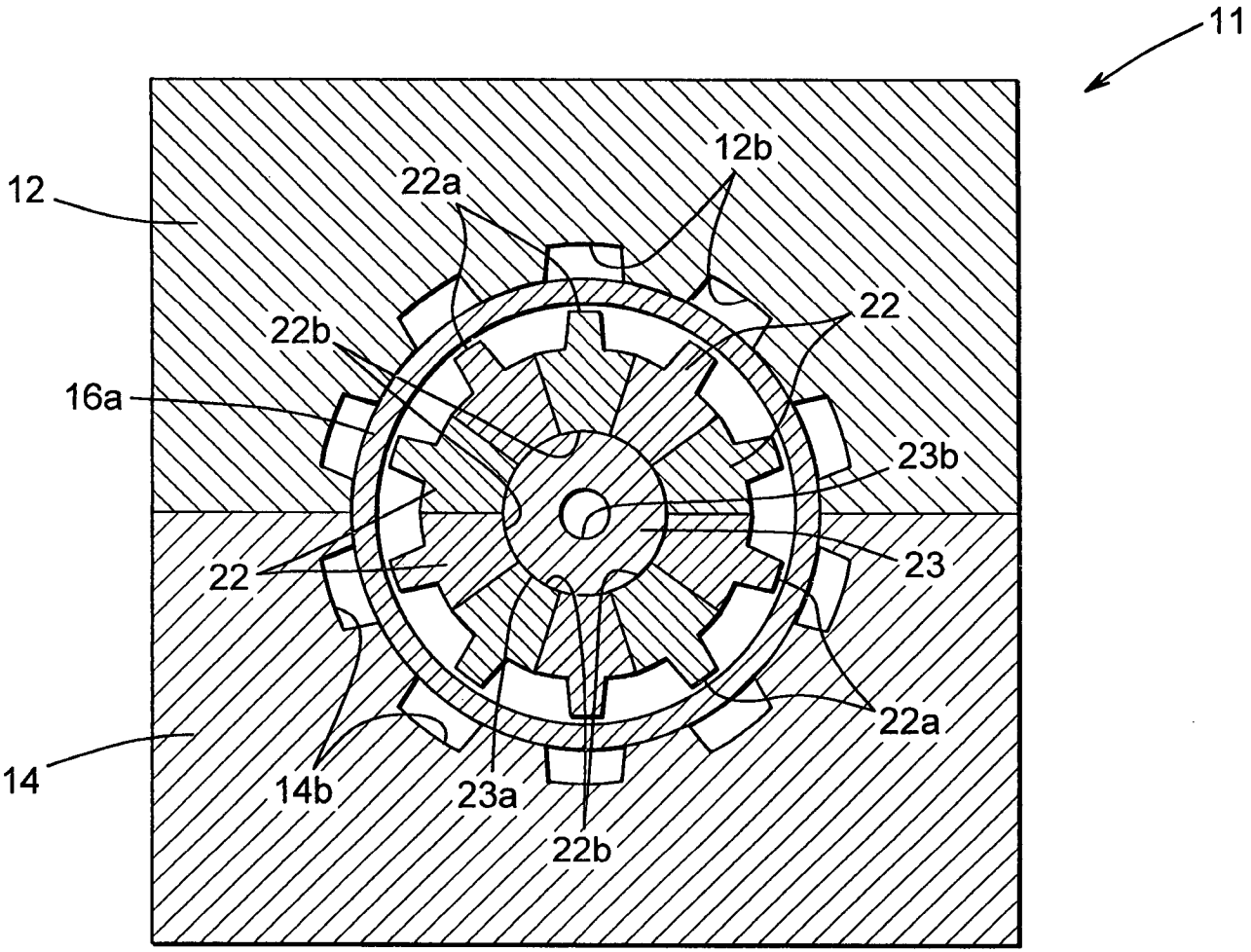
FIG. 5 is an enlarged sectional elevational view taken along line 5-5 of FIG. 4.
Figure 6:
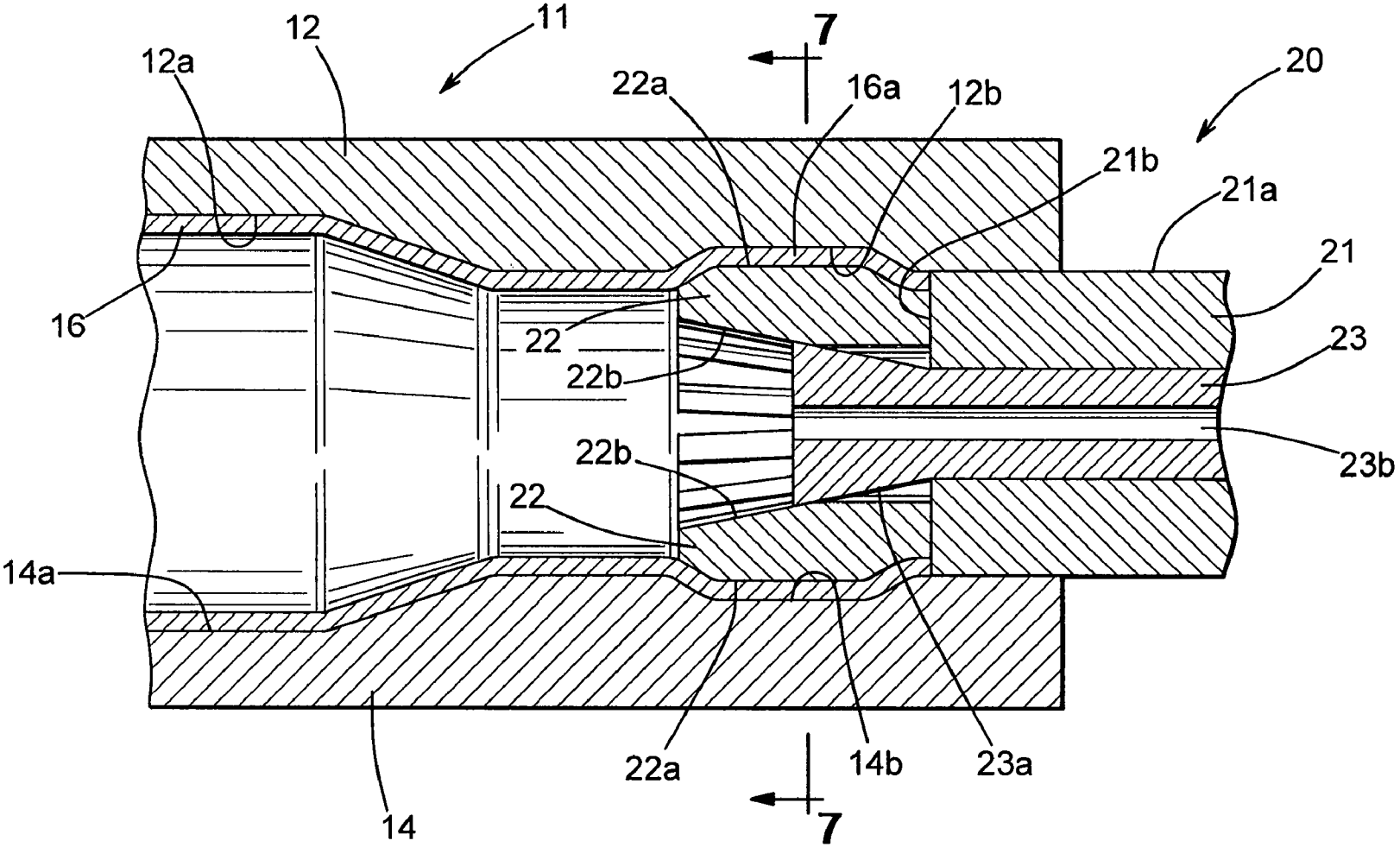
FIG. 6 is a side elevational view in cross section similar to FIG. 4 showing the end forming assembly after being actuated to deform the end portion of the workpiece, and farther after pressurized fluid has been supplied within the workpiece to deform an interior portion thereof.
Figure 7:
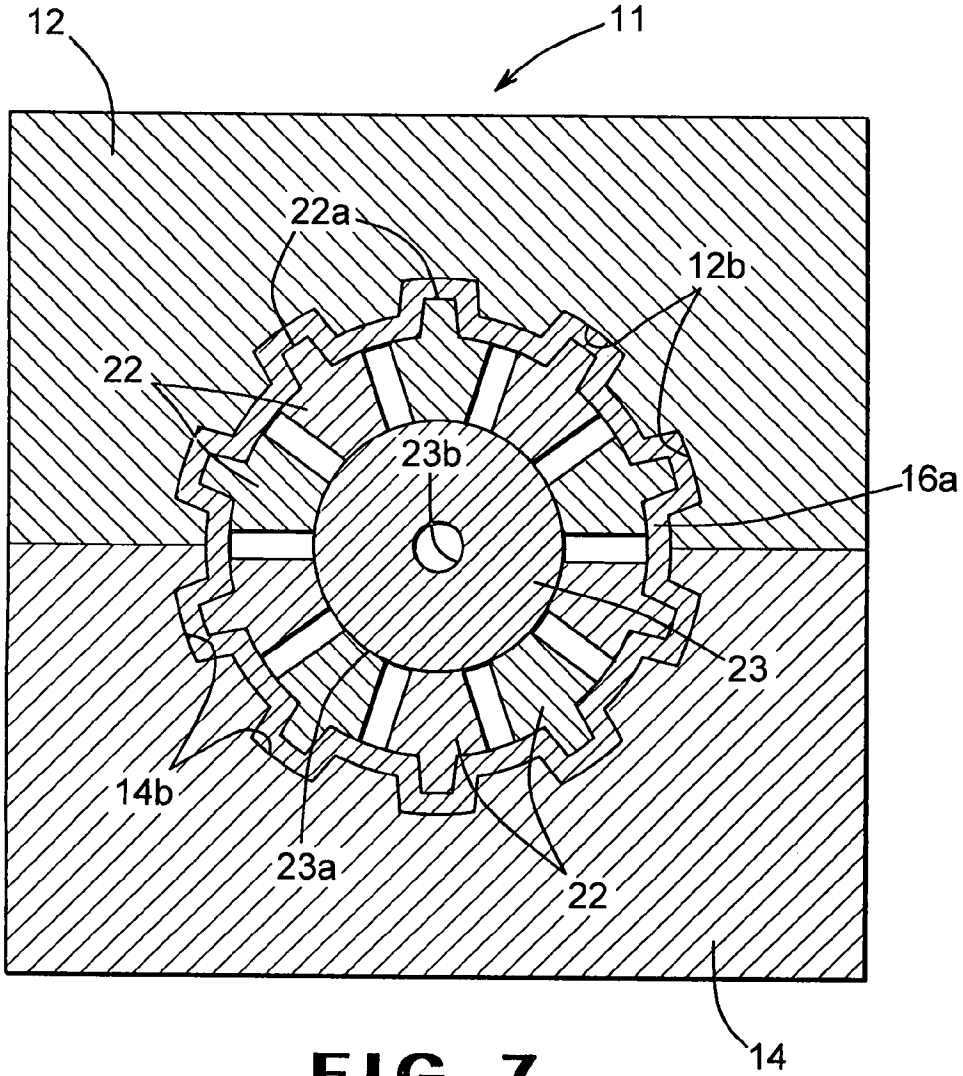
FIG. 7 is a sectional elevational view taken along line 7-7 of FIG. 6.

The illustrated end feed assembly 20 also includes a forming portion that is supported on the sealing portion 21 adjacent to the shoulder 21*b*. In the illustrated embodiment, the forming portion of the end feed assembly includes a plurality of wedge-shaped segments 22 that are disposed in a circumferential array (best shown in FIGS. 5 and 7). Each of the segments 22 has an outer surface 22*a* and an inner surface 22*b*. The outer surfaces 22*a* of the segments 22 preferably define a circumferential shape that corresponds with a circumferential shape defined by the inner surface of the associated end cavity area of the hydroforming die cavity. As best shown in FIGS. 5 and 7, the outer surfaces 22*a* of the segments 22 define a circumferential shape that is characterized by a plurality of axially extending protrusions, while the inner surface of the associated end cavity area of the hydroforming die cavity defines a circumferential shape that is characterized by a plurality of axially extending recesses. Such shapes are suitable for forming a plurality of axially extending splines in the end portion 16*a* of the workpiece 16 in the manner described below. However, it will be appreciated that the outer surfaces 22*a* of the segments 22 and the inner surface of the end cavity area of the hydroforming die cavity may define any desired shape or shapes. The illustrated inner surfaces 22*b* of the segments 22 are tapered in the axial direction from a relatively small diameter (located adjacent to the sealing portion 21) to a relatively large diameter (located away from the sealing portion 21), as best shown in FIGS. 2, 4, and 6, although such is not required. The purpose for such tapered inner surfaces 22*b* will be explained below.

The illustrated end feed assembly 20 further includes an actuating mechanism for selectively moving the segments 22 of the forming portion of the end feed assembly 20 radially between a retracted position, illustrated in FIGS. 4 and 5, and an extended position, illustrated in FIGS. 6 and 7. In the illustrated embodiment, the actuating mechanism is a control pin 23 that extends axially through both the sealing portion 21 and the forming portion 22 of the end feed assembly 20. The control pin 23 has an outer surface 23*a* and a central passageway 23*b* formed therethrough. The illustrated outer surface 23*a* of the control pin 23 is tapered in the axial direction from a relatively small diameter (located adjacent to the sealing portion 21) to a relatively large diameter (located away from the sealing portion 21), as best shown in FIGS. 2, 4, and 6, although such is not required. The tapered outer surface 23*a* of the control pin 23 engages the tapered inner surfaces 22*b* of the segments 22. Thus, when the control pin 23 is moved axially in a first direction (toward the left when viewing FIGS. 2, 4, and 6), the outer tapered surface 23*a* of the control pin 23 cooperates with the tapered inner surfaces 22*b* of the segments 22 to allow such segments 22 to move radially inwardly to the retracted position illustrated in FIGS. 4 and 5. When the control pin 23 is moved axially in a second direction (toward the right when viewing FIGS. 2, 4, and 6), the outer tapered surface 23*a* of the control pin 23 cooperates with the tapered inner surfaces 22*b* of the segments 22 to move such segments 22 radially outwardly to the extended position illustrated in FIGS. 6 and 7. The illustrated central passageway 23*b* extends completely through the control pin 23 from one axial end to the other, although such is not required. The purpose for such central passageway 23*b* will also be explained below.

The operation of the hydroforming apparatus will now be described with reference to the drawings. Initially, the first and second die sections 12 and 14 are moved to the opened position, and the end feed assemblies 20 are retracted away from such die sections 12 and 14 by the associated actuators 20*a*, as shown in FIG. 1. Then, the workpiece 16 is disposed between the first and second die sections 12 and 14, as also shown in FIG. 1. If desired, the workpiece 16 can be pre-bent or otherwise preliminarily deformed before being placed within the die cavity. Next, the first and second die sections 12 and 14 are moved to the closed position illustrated in FIGS. 2 and 3, and the end feed assemblies 20 are moved into engagement with the respective end portions 16*a* of the workpiece 16 by the associated actuators 20*a*, as shown in FIGS. 4 and 5. In this position, the forming portion 22 of the end feed assembly 20 is disposed within the end portion 16*a* of the workpiece 16, while the shoulder 21*b* of the sealing portion 21 of the end feed assembly 20 abuts the end portion 16*a* of the workpiece 16. These movements of the first and second die sections 12 and 14 and the movement of the end feed assemblies 20 can be performed in any desired order or simultaneously if desired.

Figure 8:
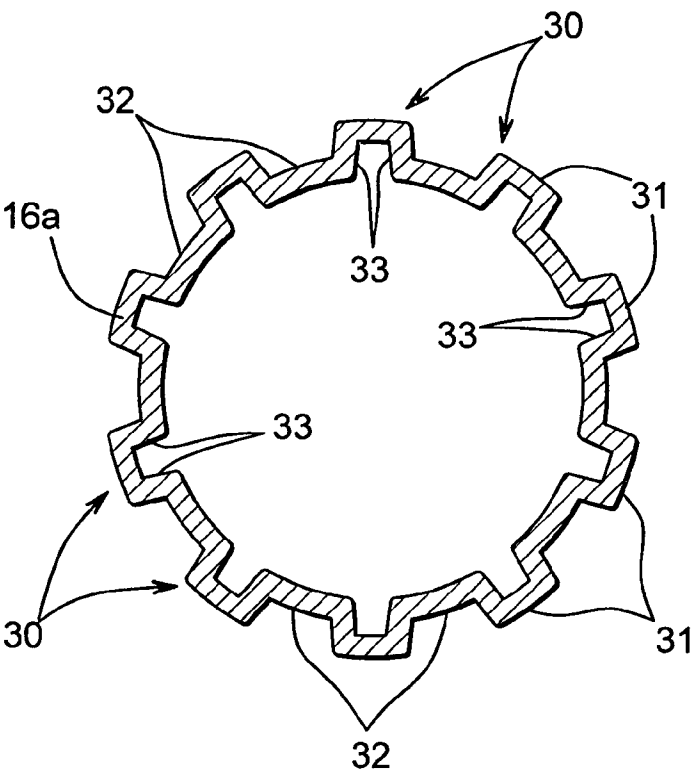
FIG. 8 is a sectional elevational view of the end portion of the hydroformed workpiece after being removed from the hydroforming apparatus.

Next, as shown in FIGS. 6 and 7, the end feed assembly 20 is actuated to engage and deform the end portion 16*a* of the workpiece 16. This is accomplished by moving the control pin 23 in the second direction (toward the right when viewing FIGS. 2, 4, and 6). As described above, such movement of the control pin 23 causes the segments 22 of the forming portion of the end feed assembly 20 to move radially outwardly to the extended position illustrated in FIGS. 6 and 7. As a result, the end portion 16*a* of the workpiece 16 is deformed into engagement with the end cavity areas defined by the recesses 12*b* and 14*b*. In the illustrated embodiment, the outer surfaces 22*a* of the segments 22 define a circumferential shape that is characterized by a plurality of axially extending protrusions, while the inner surface of the associated end cavity area of the hydroforming die cavity defines a circumferential shape that is characterized by a plurality of axially extending recesses. Thus, as best shown in FIG. 8, a plurality of axially extending splines, indicated generally at 30, is formed in the end portion 16*a* of the workpiece 16 when the forming portion 22 of the end feed assembly 20 is operated. The illustrated splines 30 are defined by a plurality of outer circumferential portions 31, a plurality of inner circumferential portions 32, and a plurality of side walls 33 that extend generally radially between the outer circumferential portions 31 and the inner circumferential portions 32.

As also shown in FIG. 6, the hydroforming apparatus 10 is also operated to deform the workpiece 16 to a desired shape. This is accomplished by filling the workpiece 16 with a fluid, typically a relatively incompressible liquid such as water. Such fluid can be supplied within the workpiece 16 from a source of pressurized fluid (not shown) through the central passageway 23*b* formed through the control pin 23 of the end feed assembly 20. The pressure of the fluid within the workpiece 16 is then increased to such a magnitude that the central portion of the workpiece 16 is deformed outwardly into conformance with the surface contour of the central die cavity area. As a result, the workpiece 16 is deformed into the desired final shape. If desired, the end feed assemblies 20 can be moved by the respective actuators 20*a* to exert axially inwardly directed forces against the opposed end portions 16*a* of the workpiece 16 while the central portion of the workpiece 16 is deformed outwardly into conformance with the surface contour of the central die cavity area. As a result, some of the material from the end portions 16*a* of the workpiece 16 is pushed within the hydroforming die 11 as the central portion of the workpiece 16 is being deformed. This hydroforming process can be performed either before, during, or after the deformation of the end portions 16*a* of the workpiece 16, as described above. Lastly, the fluid is drained from the workpiece 16, and the first and second die sections 12 and 14 are moved to the opened position to allow the deformed workpiece 16 to be removed.

Figure 9:
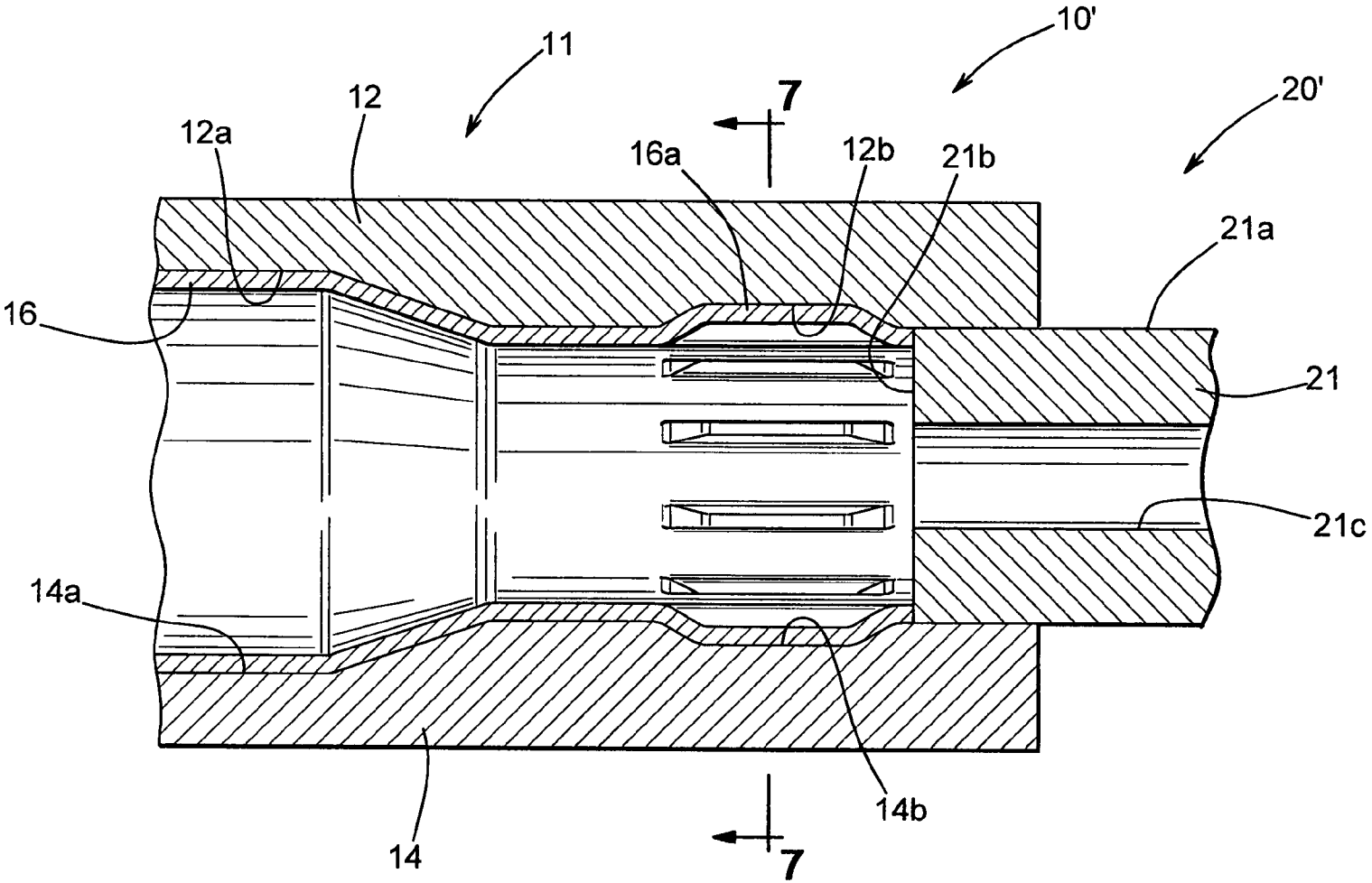
FIG. 9 is side elevational view in cross section similar of a portion of a second embodiment of a hydroforming apparatus and a workpiece after being actuated to deform both an interior portion thereof and an end portion thereof.

FIG. 9 illustrates a portion of a second embodiment of a hydroforming apparatus, indicated generally 10' in accordance with this invention. The second embodiment of the hydroforming apparatus 10' is similar to the first embodiment of the hydroforming apparatus 10 described above, and like reference numbers are used to indicated similar components. In the second embodiment of the hydroforming apparatus 10', a modified end feed assembly 20' is provided that includes the sealing portion 21 described above, but does not include the forming portion 22. During the hydroforming process, the pressure of the fluid within the workpiece 16 is increased to such a magnitude that both (1) the central portion of the workpiece 16 is deformed outwardly into conformance with the surface contour of the central die cavity area and (2) the end portion 16*a* of the workpiece 16 is deformed outwardly into conformance with the surface contour of the end cavity area. As a result, the workpiece 16 is deformed into the desired final shape and has a plurality of splines 30 provided on the end portions 16*a* thereof. As described above, the end feed assemblies 20 can be moved by the respective actuators 20*a* to exert axially inwardly directed forces against the opposed end portions 16*a* of the workpiece 16 while the central portion of the workpiece 16 is deformed outwardly into conformance with the surface contour of the central die cavity area.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method of performing a hydroforming process comprising the steps of:

(a) providing first and second die sections having cooperating recesses formed therein that together define a die cavity and an end feed assembly;

(b) providing a workpiece having an interior portion and an end portion;

(c) orienting the workpiece relative to the first and second die sections such that the interior portion of the workpiece is disposed within the die cavity;

(d) causing the end feed assembly to seal against the end portion of the workpiece and to deform the end portion of the workpiece to a desired shape; and (e) while said step (d) is being performed, providing fluid through the end feed assembly into the workpiece so as to deform the interior portion of the workpiece into conformance with the die cavity.

2. The method defined in claim 1 wherein said step (a) is performed by providing each of the first and second die sections with a central cavity area and an end cavity area, and wherein said step (d) is performed by deforming the end portion of the workpiece into conformance with the end cavity area, and wherein said step (e) is performed by deforming the interior portion of the workpiece into conformance with the central cavity area.

3. The method defined in claim 2 wherein said step (a) is performed by providing an end feed assembly having a sealing portion and a forming portion, and wherein said step (d) is performed by actuating the forming portion of the end feed assembly to deform the end portion of the workpiece into conformance with the end cavity area.

4. The method defined in claim 3 wherein said step (a) is performed by providing the forming portion of the end feed assembly with a plurality of segments, and wherein said step (d) is performed by moving the plurality of segments to deform the end portion of the workpiece into conformance with the end cavity area.

5. The method defined in claim 4 wherein said step (a) is performed by providing each of the plurality of segments with a tapered inner surface, and wherein said step (d) is performed by moving a control pin having a tapered outer surface relative to the tapered inner surfaces of the plurality of segments to deform the end portion of the workpiece into conformance with the end cavity area.

6. The method defined in claim 1 wherein said step (a) is performed by providing each of the fast and second die sections with an end cavity area having an inner shape and by providing the forming portion of the end feed assembly with an outer shape that corresponds with the inner shape of the end cavity area, and wherein said step (d) is performed by actuating the forming portion of the end feed assembly to deform the end portion of the workpiece into conformance with the cooperating shapes defined by the end cavity area and the forming portion of the end feed assembly.

7. The method defined in claim 1 wherein said step (a) is performed by providing an end feed assembly having a sealing portion and a forming portion, and wherein said step (d) is performed by actuating the forming portion of the end feed assembly to deform the end portion of to workpiece into conformance with the end cavity area.

8. The method defined in claim 7 wherein said step (a) is performed by providing the forming portion of the end feed assembly with a plurality of segments, and wherein said step (d) is performed by moving the plurality of segments to deform the end portion of the workpiece into conformance with the end cavity area.

9. The method defined in claim 8 wherein said step (a) is performed by providing each of the plurality of segments with a tapered inner surface, and wherein said step (d) is performed by moving a control pin having a tapered outer surface relative to the tapered inner surfaces of the plurality of segments to deform the end portion of the workpiece into conformance with the end cavity area.

10. An apparatus for performing a hydroforming process comprising:

a frame;

first and second die sections supported on said frame and having cooperating recesses formed therein that together define a die cavity adapted to receive a workpiece; and an end feed assembly supported on said frame, said end feed assembly including a sealing portion tat is adapted to seal against an end portion of a workpiece and a forming portion that is adapted to deform an end portion of a workpiece to a desired shape, said forming portion of said end feed assembly including a plurality of segments that is movable from a retracted position to an extended position.

11. The apparatus defined in claim 10 wherein said end feed assembly further includes a control pin, wherein movement of said control pin causes movement of said plurality of segments between said retracted and extended positions.

12. The apparatus defined in claim 11 wherein each of said plurality of segments has a tapered inner surface, and wherein said control pin has a tapered outer surface that engages said inner surfaces of said plurality of segments.

13. The apparatus defined in claim 10 wherein said end feed assembly has a passageway theretbrough tat is adapted to allow fluid to flow therethrough into and out of the workpiece.

14. A method of performing a hydroforining process comprising the steps of:

(a) providing (1) first and second die sections having cooperating recesses formed therein that together define a die cavity and (2) an end feed assembly having a sealing portion and a forming portion having a plurality of segments;

(b) providing a workpiece having an interior portion and an end portion;

(c) orienting the workpiece relative to the first and second die sections such that the interior portion of the workpiece is disposed within the die cavity;

(d) causing the sealing portion of the end feed assembly to seal against the end portion of the workpiece and moving the segments of the forming portion of the end feed assembly to deform the end portion of the workpiece to a desired shape; and (e) providing fluid through the end feed assembly into the workpiece so as to deform the interior portion of the workpiece into conformance with the die cavity.

15. The method defined in claim 14 wherein said step (a) is performed by providing each of the first and second die sections with a central cavity area and an end cavity area, and wherein said step (d) is performed by defonning the end portion of the workpiece into conformance with the end cavity area, and wherein said step (e) is performed by deforniing the interior portion of the workpiece into conformance with the central cavity area.

16. The method defined in claim 14 wherein said step (a) is performed by providing each of the plurality of segments with a tapered inner surface, and wherein said step (d) is performed by moving a control pin having a tapered outer surface relative to the tapered inner surfaces of the plurality of segments to deform the end portion of the workpiece into conformance with the end cavity area.

17. The method defined in claim 14 wherein said step (a) is performed by providing each of the first and second die sections with an end cavity area having an inner shape and by providing the forming portion of the end feed assembly with an outer shape that corresponds with the inner shape of the end cavity area, and wherein said step (d) is perfonned by actuating the forming portion of the end feed assembly to deform the end portion of the workpiece into conformance with the cooperating shapes defined byte end cavity area and the forming portion of the end feed assembly.

18. The method defined in claim 14 wherein said step (e) is performed before said step (d).

19. The method defined in claim 14 wherein said step (e) is performed during said step (d).

20. The method defined in ClaIm 14 wherein said step (e) is performed after said step (d).

* * * * *

UNITED STATES PATENT AND TRADEMARK OFFICE

CERTIFICATE OF CORRECTION

PATENT NO. : 7,284,403 B2 
APPLICATION NO. : 11/320526
DATED : October 23, 2007
INVENTOR(S) : Nelson Wagner and Jeffrey A. Dutkiewicz It is certified that error appears in the above-identified patent and that said Letters Patent is hereby corrected as shown below:

In the claims:

Column 8, Claim 6, Line 25, delete “fast”, insert --first--;

Column 8, Claim 7, Line 38, delete “to”, insert --the--;

Column 8, Claim 10, Line 61, delete ‘tat”, insert --that--;

Column 9, Claim 13, Line 10, delete “theretbrough”, insert --therethrough--; delete “tat”, insert --that--;

Column 9, Claim 14, Line 13, delete “hydroforining”, insert --hydroforming--;

Column 10, Claim 15, Line 2, delete “defonning”, insert --deforming--;

Column 10, Claim 15, Line 5, delete “deforniing”, insert --deforming--;

Column 10, Claim 17, Line 21, delete “perfonned”, insert --performed--; and

Column 10, Claim 17, Line 24, delete “byte”, insert --by the--.

Signed and Sealed this

Eleventh Day of March, 2008

JON W. DUDAS
*Director of the United States Patent and Trademark Office*